PROCESSING SOLUTION HAVING BLEACHING ABILITY FOR LIGHT-SENSITIVE SILVER HALIDE COLOR PHOTOGRAPHIC MATERIAL

BACKGROUND OF THE INVENTION

This invention relates to a processing solution having a bleaching ability for a light-sensitive silver halide color photographic material. More particularly, this invention pertains to an effective bleaching solution and bleach-fixing solution for a light-sensitive silver halide color photographic material which is improved in various processing performances and liquid characteristics.

In general, in order to obtain a color image by processing of a light-sensitive silver halide color photographic emulsion subjected to imagewise exposure, there is provided, after the step of color development, the step of processing the silver halide formed with a processing solution having a bleaching ability.

As the processing solution having a bleaching ability, a bleaching solution and a bleach-fixing solution are known. When a bleaching solution is used, the step of fixing of silver halide with a fixing agent is usually added subsequent to the bleaching step. On the other hand, with the use of a bleach-fixing solution, bleaching and fixing are effected in one step.

As the processing solution having a bleaching ability in processing of a light-sensitive silver halide color photographic material, there have widely been used inorganic oxidizing agents such as red prussiate, dichromate, persulfate, iron chloride, etc. which are oxidizing agents for bleaching the image silver.

However, it has been pointed out that the processing solution containing these inorganic oxidizing agents involve some serious drawbacks. For example, red prussiate and dichromate, although they are excellent in bleaching power of image silver, have the problem of being decomposed to form cyan ions or hexavalent chromium ions which may be harmful to human bodies, thus having unfavorable properties from the standpoint of prevention of pollution. Also, since these oxidizing agents have very strong oxidative power, it is difficult to permit a silver halide solubilizing agent such as a thiosulfate salt to coexist in the same processing solution. Therefore, it is almost impossible to use these oxidizing agents in a bleach-fixing bath, whereby the objects of speed-up and simplification of processing can hardly be accomplished. Further, the processing solution containing these inorganic oxidizing agents has also another drawback that it is difficult to reuse the waste liquor after processing without being discarded.

In contrast, a processing solution is coming into use which causes little problem in pollution and also meets the requirements of rapid and simple processing as well as enabling regeneration and reuse, which contains a metal complex salt of an organic acid such as an aminopolycarboxylic acid metal complex salt, etc. However, a processing solution utilizing a metal complex salt of an organic acid has a moderate oxidizing power and therefore has the drawback of slow bleaching speed (oxidizing speed) of the image silver (metal silver) formed in the developing step. For example, ethylenediaminetetraacetic acid iron (III) complex salt, which is considered to have a potent bleaching power among the aminopolycarboxylic acid metal complexe salts, is utilized as the bleaching solution and bleach-fixing solution in some practical applications. However, it is deficient in bleaching action in high sensitivity light-sensitive silver halide color photographic materials composed primarily of silver bromide or silver iodobromide emulsions, particularly color paper for photographing, color negative film for photographing and color reversal film containing silver iodide, whereby traces of image silver will remain even after prolonged processing to give poor silver elimination characteristic. This tendency will appear particularly markedly because of lowering in redox potential in a bleach-fixing solution where an oxidizing agent and a thiosulfate or thiosulfite coexist.

On the other hand, enormous effors have been made in developing a bleaching promoter for increasing the silver bleaching power of a bleaching solution or a bleach-fixing solution containing a metal complex salt of an organic acid, but no satisfactory result has yet been obtained.

Among the aminopolycarboxylic acids metal salt complexes, the present inventors have found diethylenetriaminepentaacetic acid iron (III) complex salt as an oxidizing agent having excellent oxidizing power particularly at higher pH region. A bleaching solution and a bleach-fixing solution containing diethylenetriaminepentaacetic acid iron (III) complex salt as the oxidizing agent has very excellent performances such as rapid silver bleaching reaction, little generation of stain when subjected directly to bleaching processing and further good storage stability of the bleach-fixing solution. However, when diethylenetriaminepentaacetic acid iron (III) complex salt is used as the oxidizing agent in a bleaching solution or a bleach-fixing solution, it was found that yellow staining, probably caused by coloration of iron (III) complex salt, was liable to occur. In particular, in the case of shortage of washing water, marked yellow staining is observed as a serious problem in photographic performance. Accordingly, it would be very desirable to develop a technique which can prevent yellow staining by diethylenetriaminepentaacetic acid iron (III) complex salt, and does not impair the silver bleaching ability, stain resistance and liquid storability of diethylenetriaminepentaacetic acid iron (III) complex salt.

Further, a bleaching solution and a bleach-fixing solution containing a diethylenetriaminepentaacetic acid iron (III) complex salt as the oxidizing agent has excellent performances that it is rapid in silver bleaching reaction at pH 4 or higher, particularly at pH 7 or higher, little in generation of stain when subjected directly to bleaching treatment and further good in storage stability of the bleach-fixing solution. However, it has now been revealed that when such a bleaching solution or a bleach-fixing solution is used and continuous processing is performed by an automatic developing machine, lowering in silver bleaching power and the so-called bad color restoration occur, which is a phenomenon such that the cyan dye converted to leuco form cannot sufficiently color formed by bleaching or bleach-fixing processing. The lowering in bleaching power and bad color restoration will occur particularly markedly when continuous processing is continued over a long time.

The present inventors have made studies over the causes for generation of such troubles. It has now been found that the diethylenetriaminepentaacetic acid iron (II) complex salt formed by silver bleaching reaction cannot be sufficiently oxidized into the diethylenetriaminepentaacetic iron (III) complex salt, whereby the triaminepentaacetic acid iron (II) complex salt can be air oxidized at a rate, which is very slow in the order of about 1/10 of that of the aforesaid ethylenediaminetetraacetic iron (II) complex salt, it was found to be unable to be oxidized according to such conventional air oxidation methods.

The above second aspect of this invention has been accomplished as a result of various investigations to promote air oxidation of a corresponding iron (II) complex salt to an iron (III) complex salt, while maintaining various excellent characteristics possessed by the diethylenetriaminepentaacetic acid iron (III) complex salt.

The diethylenetriaminepentaacetic acid iron (III) complex salt according to this invention may be used as a free acid (hydrogen salt), an alkali metal salt such as sodium salt, potassium salt or lithium salt, or an ammonium salt or an aqueous amine salt such as triethanolamine salt, but preferably potassium salt, sodium salt and ammonium salt. These iron (III) complexes may be used either alone or as a combination of two or more species. The amount to be used may be chosen as desired, depending on the silver quantity in the light-sensitive material and the composition of the silver halide. Since the complex salt is generally higher in oxidative power, it can be used at a lower concentration than other aminopolycarboxylic acid salts. For example, it can be used at 0.01 mole or more, preferably 0.05 mole or more, per one liter of the solution used. In either case, the upper limit for the concentration is preferably 2 moles per liter of the solution. In this connection, in a replenishing solution, for the purpose of supplementing at a low level with conc. solution, it is desirable to make its concentration up to saturation of the solubility.

The metal ion to be used in the present invention may be supplied according to any desired method. For example, it can be supplied in any form such as halide, hydroxide, sulfate, carbonate, phosphate, acetate, etc. Particularly, it is effective to supply the metal ion by the specific compounds set forth below (hereinafter, the metal compound for supplying the metal ion of the present invention is called as "metal compound of the present invention"). However, these supplying methods are not limitative of the present invention, for example, an electrical method may be available.

[Exemplary compounds]

(A-1) Zinc chloride
(A-2) Zinc bromide
(A-3) Zinc sulfate
(A-4) Zinc nitrate
(A-5) Nickel chloride
(A-6) Nickel nitrate
(A-7) Nickel sulfate
(A-8) Nickel acetate
(A-9) Nickel bromide
(A-10) Nickel iodide
(A-11) Nickel phosphate
(A-12) Cobalt chloride
(A-13) Cobalt nitrate
(A-14) Cobalt sulfate
(A-15) Cobalt acetate
(A-16) Cerium sulfate
(A-17) Ruthenium sulfate
(A-18) Ruthenium chloride
(A-19) Yttrium sulfate
(A-20) Yttrium nitrate
(A-21) Yttrium chloride
(A-22) Yttrium fluoride
(A-23) Samarium chloride
(A-24) Samarium bromide
(A-25) Samarium sulfate
(A-26) Samarium carbonate
(A-27) Samarium nitrate
(A-28) Samarium acetate
(A-29) $Mg(CH_3COO)_2.4H_2O$
(A-30) $MgCl_2.6H_2O$
(A-31) $Mg_3(C_6H_5O_7)_2.14H_2O$
(A-32) $Mg(NO_3)_2.6H_2O$
(A-33) $MgC_2O_4.2H_2O$
(A-34) $Mg_3(PO_4)_2.5H_2O$
(A-35) $MgSO_4.7H_2O$
(A-36) $Ca(CH_3COO)_2.H_2O$
(A-37) $CaCO_3$
(A-38) $CaCl_2.2H_2O$
(A-39) $Ca(C_6H_5O_7)_2.4H_2O$
(A-40) $Ca(OH)_2$
(A-41) $CaC_4H_2O_4$
(A-42) $Ca(NO_3)_2.4H_2O$
(A-43) $BiCl_3$
(A-44) $BiC_6H_5O_7$
(A-45) $Bi(NO_3)_3.5H_2O$
(A-46) $Sr(CH_3COO)_2.\frac{1}{2}H_2O$
(A-47) $SrCO_3$
(A-48) $SrCl_2.6H_2O$
(A-49) $SrSO_4$
(A-50) $Mn(CH_3COO)_2.4H_2O$
(A-51) $MnCO_3.nH_2O$
(A-52) $MnCl_2.4H_2O$
(A-53) $Mn(NO_3)_2.nH_2O$
(A-54) $MnSO_4.nH_2O$
(A-55) $AlCl_3.6H_2O$
(A-56) $Al(NO_3)_3.9H_2O$
(A-57) $AlPO_4$
(A-58) $SnCl_2.2H_2O$
(A-59) $SnCl_4$
(A-60) $SnSO_4$
(A-61) $BaCl_2$
(A-62) $Ba(NO_3)_2$
(A-63) $In_2(SO_4)_3$
(A-64) $InCl_3$
(A-65) TlCl
(A-66) $Tl(NO_3)_2$
(A-67) $Zr(SO_4)_2.4H_2O$
(A-68) Diethylenetriaminepentaacetic acid sodium magnesium salt
(A-69) Diethylenetriaminepentaacetic acid ammonium calcium salt
(A-70) Diethylenetriaminepentaacetic acid sodium manganese salt
(A-71) Diethylenetriaminepentaacetic acid ammonium cerium salt
(A-72) Ethylenediaminetetraacetic acid ammonium magnesium salt
(A-73) Ethylenediaminetetraacetic acid sodium calcium salt
(A-74) Ethylenediaminetetraacetic acid sodium manganese salt
(A-75) Ethylenediaminetetraacetic acid ammonium cerium salt
(A-76) Ethylenediaminetetraacetic acid ammonium bismuth salt
(A-77) Hydroxyethyliminodiacetic acid magnesium
(A-78) Hydroxyethyliminodiacetic acid calcium
(A-79) Hydroxyethyliminodiacetic acid nickel (A-80) Hydroxyethyliminodiacetic acid manganese
(A-81) Hydroxyethyliminodiacetic acid cobalt
(A-82) Hydroxyethyliminodiacetic acid cerium chloride
(A-83) Nitrilotriacetic acid sodium magnesium salt
(A-84) Nitrilotriacetic acid ammonium calcium salt
(A-85) Nitrilotriacetic acid ammonium manganese salt
(A-86) Nitrilotriacetic acid cerium
(A-87) Hydroxyethylethylenediamine triacetic acid sodium magnesium salt
(A-88) Hydroxyethylethylenediamine triacetic acid ammonium calcium salt
(A-89) Hydroxyethylethylenediamine triacetic acid ammonium nickel salt
(A-90) Hydroxyethylethylenediamine triacetic acid sodium manganese salt
(A-91) Hydroxyethylethylenediamine triacetic acid sodium cobalt salt
(A-92) Hydroxyethylethylenediamine triacetic acid cerium
(A-93) Diaminopropanetetraacetic acid sodium magnesium salt
(A-94) Diaminopropanetetraacetic acid ammonium calcium salt
(A-95) Diaminopropanetetraacetic acid ammonium nickel salt
(A-96) Diaminopropanetetraacetic acid sodium manganese salt
(A-97) Diaminopropanetetraacetic acid ammonium cobalt salt
(A-98) Diaminopropanetetraacetic acid ammonium cerium salt These metal compounds of the present invention can be used either singly or as a combination of two or more compounds. Its amount to be used may range from 0.0001 mole to 2 moles, but preferably it should range from 0.001 mole to 1 mole, per liter of the solution employed. More preferably, it ranges from 0.01 mole to 2 moles per liter of the solution. However, it may range from 0.003 mole to 2 mole per liter of the solution when the metal compound is selected from compounds of Ni, Co, Zn, Ce, Ru, Y and Sm, or it may range from 0.005 mole to 2 mole per liter of the solution when the metal compound is selected from compounds of Mg, Ca, Bi, Sr, Mn, Al, Sn, Ba, In, Tl and Zr.

The chelating agent which can be effectively utilized in the present invention may include dicarboxylic acids, polycarboxylic acids, oxycarboxylic acids, aminopolycarboxylic acids, polyphosphoric acids, organic phosphonic acids, aminopolycarboxylic acids, phosphonocarboxylic acids and the like. In particular, aminopolycarboylic acids as enumerated below can effectively be used.

[Exemplary compounds]

(B-1) Dihydroxyethylglycine
(B-2) Iminodiacetic acid
(B-3) Methyliminodiacetic acid
(B-4) Ethyliminodiacetic acid
(B-5) Butyliminodiacetic acid
(B-6) Hydroxyethyliminodiacetic acid
(B-7) Nitrilotriacetic acid
(B-8) Nitrilotriacetic propionic acid
(B-9) Nitrilotripropionic acid
(B-10) Ethylenediaminediacetic acid
(B-11) Ethylenediaminedipropionic acid
(B-12) Ethylenediamine di-ortho-hydroxyphenyl acetic acid
(B-13) Hydroxyethylethylenediamine triacetic acid
(B-14) Ethylenediaminetetraacetic acid
(B-15) Diaminopropanetetraacetic acid
(B-16) Diaminopropanoltetraacetic acid
(B-17) Trans-cyclohexanediaminetetraacetic acid
(B-18) Glycoletherdiaminetetraacetic acid
(B-19) Triethylenetetraminehexaacetic acid These chelating agents of the present invention may be used as either free acids, alkali metal salts such as sodium salts, potassium salts, lithium salts, etc., or ammonium salts or water-soluble amine salts such as triethanolamine salts. These may be used either as a single species or as a combination of two or more species. The amount to be used may be preferably 0.0001 to 2 moles, particularly preferably from 0.001 to 1 mole, per one liter of the solution employed.

When a diethylenetriaminepentaacetic acid is used in place of the chelating agent other than the diethylenetriaminepentaacetic acid, the air oxidation of a diethylenetriaminepentaacetic acid iron (II) complex salt to an iron (III) complex salt cannot sufficiently be promoted. However, when the diethylenetriaminepentaacetic acid is used in combination with the chelating agent other than the diethylenetriaminepentaacetic acid, the air oxidation from an iron (II) complex salt to an iron (III) complex salt can sufficiently be promoted. In other words, in the present invention, said diethylenetriaminepentaacetic acid may be either added or not, but it may be added without problem when at least one of the chelating agent other than the diethylenetriaminepentaacetic acid is added.

The above metal compound and chelating agent of the present invention may be added separately or they can be added as a metal chelate compound.

The bleach-fixing solution of this invention may be used at a pH of from pH 3 to pH 9.5, preferably 4.0 or higher, more preferably 5.0 or higher, most preferably from pH 5.5 to pH 9.0. The processing temperature employed may be 80° C. or lower, preferably 55° C. or lower, while suppressing evaporation.

The bleach-fixing solution of the present invention, in addition to diethylenetriaminepentaacetic acid iron (III) complex salt as the bleaching agent, the metal ion and the chelating agent of the present invention, can also contain various additives. As the additive, it is preferred to incorporate an alkali halide or ammonium halide such as potassium bromide, sodium bromide, sodium chloride, ammonium bromide, potassium iodide, sodium iodide, ammonium iodide, thiourea, etc. It is also possible to add a pH buffering agent such as borate, oxalate, acetate, carbonate, phosphate, etc., a solubilizing agent such as triethanolamine, an alkylamine, or a polyethylene oxide, which are generally known to be added into a bleaching solution.

As the bleach-fixing solution of the present invention, it is possible to apply a solution containing the foresaid diethylenetriaminepentaacetic acid iron (III) complex salt and the metal ion of the present invention as the bleaching agent together with a silver halide fixing agent such as thiosulfate, thiocyanate, thiourea or thioether etc. It is also possible to use a bleach-fixing solution having a composition comprising a small amount of a halide such as potassium bromide added to the bleaching agent of the present invention and the aforesaid silver halide fixing agent, or a bleach-fixing solution with a composition comprising contrariwise a large amount of a halide such as potassium bromide added, or further a special bleach-fixing solution with a composition comprising a combination with a large amount of a halide such as potassium bromide.

As the above-mentioned halide, in addition to potassium bromide, there may also be employed hydrochloric acid, hydrobromic acid, lithium bromide, sodium bromide, ammonium bromide, sodium iodide, potassium iodide, ammonium iodide and the like.

The silver halide fixing agent to be incorporated in the bleach-fixing solution may include compounds which can react with a silver halide conventionally used for fixing processing in general to form a water-soluble complex salt, typically thiosulfates such as potassium thiosulfate, sodium thiosulfate, ammonium thiosulfate; thiocyanates such as potassium thiocyanate, sodium thiocyanate, ammonium thiocyanate; or thiourea, thioether, highly concentrated bromides, iodides, etc. These fixing agents may be used in amounts of from 5 g/liter up to soluble amounts.

It is also possible to incorporate in the bleach-fixing solution a pH buffering agent comprising various acids or salts such as of boric acid, borax, sodium hydroxide, sodium carbonate, potassium carbonate, sodium bicarbonate, potassium bicarbonate, acetic acid, sodium acetate, ammonium hydroxide, etc. either singly or as a combination of two or more species. Further, various fluorescent whiteners, defoaming agents or surfactants may also be incorported. Moreover, it is also possible to incorporate suitably preservatives such as hydroxylamine, hydrazine, sulfite, meta-bisulfite, bisulfite adducts of aldehyde or ketone compounds; stabilizers such as nitroalcohol nitrate; solubilizing agents such as alkanolamines, etc.; stain preventives such as organic amines, and other additives; and organic solvents such as methanol, dimethylsulfamide, dimethyl sulfoxide, etc.

In the processing method by use of the processing solution of the present invention, the most preferred processing system is to effect bleaching or bleach-fixing immediately after color development. Alternatively, it is also possible to apply bleaching or bleach-fixing processing after processing such as washing with water, rinsing or stopping after color development. Further, a pre-bath containing a bleaching promotor may also be used as the processing solution prior to bleaching or bleach-fixing.

After bleaching and fixing (or bleach-fixing), stabilizing processing may be applied without washing with water, or alternatively processing by washing with water may be conducted before stabilizing processing. In addition to the steps as mentioned above, other known auxiliary steps may also be added, such as film hardening, neutralization, black-and-white developing, reversing, washing with a small amount of water, etc. Typical examples of preferable processing procedures including various steps are set forth below.

(1) Color developing→Bleach-fixing→Water washing
(2) Color developing→Bleach-fixing→Small amount water washing→Water washing
(3) Color developing→Bleach-fixing→Water washing→Stabilizing
(4) Color developing→Bleach-fixing→Stabilizing
(5) Color developing→Water washing→Bleach-fixing→Water washing
(6) Color developing→Stopping→Bleach-fixing→Water washing
(7) Color developing→Bleach-fixing→Water washing→Fixing→Water washing→Stabilizing
(8) Color developing→Bleaching→Fixing→Water washing→Stabilizing
(9) Color developing→Bleaching→Small amount water washing→Water washing→Fixing→Small amount water washing→Water washing→Stabilizing
(10) Color developing→Small amount water washing→Bleaching→Small amount water washing→Fixing→Small amount water washing→Water washing→Stabilizing
(11) Color developing→Stopping→Bleaching→Small amount water washing→Fixing→Small amount water washing→Water washing→Stabilizing
(12) Black-and-white developing→Washing→Reversing→Color developing→Bleaching→Fixing→Water washing→Stabilizing
(13) Pre-film-hardening→Neutralization→Black-and-white developing→Stopping→Color developing→Bleaching→Fixing→Water washing→Stabilizing The black-and-white developer to be used for processing of this invention may be the developer called as black-and-white first developer generally used for light-sensitive color photographic material known in the art or the developer used for processing of light-sensitive black-and-white photographic materials, and various additives generally added to a black-and-white developer may be incorporated therein.

Typical additives may include developing agents such as 1-phenyl-3-pyrazolidone, Metol and hydroquinone; preservatives such as sulfites; accelerators comprising an alkali such as sodium hydroxide, sodium carbonate, potassium carbonte and the like; inorganic or organic inhibitors such as potassium bromide, 2-methylbenzimidazole, methylbenzimidazole and others; hard water softeners such as polyphosphoric acid salts; and surface excessive development preventives comprising minute amount of an iodide or a mercapto compound.

An aromatic primary amine color developing agent may be used in the color developer to be used prior to the processing with the processing solution having bleaching ability according to this invention. It may include those known in the art which have widely been used in various color photographic processes. These developers include aminophenol type and p-phenylenediamine type derivatives. These compounds are generally used in salt forms such as hydrochlorides or sulfates, which are more stable than free states. These compounds may be used generally at a concentration of about 0.1 g to about 30 g per one liter of a color forming developer, more preferably about 1 g to about 15 g per one liter of a color developer.

Aminophenol type developers may include, for example, o-aminophenol, p-aminophenol, 5-amino-2-oxytoluene, 2-amino-3-oxy-toluene, 2-oxy-3-amino-1,4-dimethylbenzene and the like.

Particularly useful primary aromatic aminotype color developers are N,N-dialkyl-p-phenylenediamine type compounds, of which alkyl group and phenyl group may be either substituted or unsubstituted. Of these, examples of particularly useful compounds may include N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-$\beta$-methanesulfonamidoethyl-3-methyl-4-aminoaniline sulfate, N-ethyl-N-$\beta$-hydroxyethylaminoaniline, 4-amino-3-methyl-N,N-diethylaniline, 4-amino-N-(2-methoxyethyl)-N-ethyl-3-methylaniline-p-toluenesulfonate and the like.

An alkaline color developer may also be used prior to the processing with the processing solution having a bleaching ability of the present invention. It may contain, in addition to the aforesaid primary aromatic amine type color developer, various components conventionally added to a color developer, such as alkali agents (e.g. sodium hydroxide, sodium carbonate, potassium carbonate), water softeners and thickeners (e.g. alkali metal sulfites, alkali metal bisfulfites, alkali metal thiocyanates, alkali halides, benzyl alcohol, diethylenetriamine pentaacetate, 1-hydroxy-ethylidene-1,1-diphosphonic acid), if desired. This color developer may have a pH value, which is usually 7 or higher, most generally about 10 to about 13.

The light-sensitive silver halide color photographic material applicable for this invention may be the internal type development system containing cyan couplers or other chromogenic agents in the light-sensitive material (see U.S. Pat. Nos. 2,376,679 and 2,801,171) or otherwise the external type development system wherein a chromagenic agent is contained in the developer (see U.S. Pat. Nos. 2,252,718, 2,592,243, and 2,590,970). The chromogenic agent may be any desired one known in the art. For example, there may be employed cyan chromogenic agents having a basic structure of naphthol or phenol and capable of forming an indoaniline dye through coupling; magenta chromogenic agents having a skeltal structure of 5-pyrazolone ring having an active methylene group; yellow chromogenic agents having a structure of benzoylacetanilide, pivalylacetanilide or acylacetanilide having an active methylene chain, either having or not having a substituent at the coupling position. As such chromogenic agents, either the so-called divalent type coupler or tetravalent type coupler may be applicable. A silver halide emulsion available may be one employing any of silver halides such as silver chloride, silver bromide, silver iodide, silver chlorobromide, silver chloroiodide, silver iodobromide, silver chloroiodobromide and a mixture of any of these. As the protective colloid for these silver halides, various colloids may be available, including natural products such as gelatin as well as synthetic ones. The silver halide emulsion may also include conventonal additives for photography such as stabilizers, sensitizers, film hardeners, sensitizing dyes, surfactants, etc.

The bleaching solution and the bleach-fixing solution of the present invention may be applicable for light-sensitive silver halide color photographic materials such as color paper, color nega-film, color posi-film, color reversal film for slide, color reversal film for movie, color reversal film for TV, reversal color paper, etc.

This invention is described in greater detail below by referring to Examples, by which, however, this invention is not limited.

EXAMPLE 1

On a paper support coated on its surface with a polyethylene layer containing an anatase type titanium dioxide as the white pigment, pre-treatment was applied by corona discharging and the respective layers as shown below were successively provided by coating to prepare a color print paper.

First layer: blue-sensitive silver chlorobromide emulsion containing 5 mole % of silver chloride and also containing as yellow coupler α-[4-(1-benzyl-2-phenyl-3,5-dioxo-1,2,4-triazolidyl)]-α-pivalyl-2-chloro-5-[γ-(2,4-di-t-amylphenoxy)butylamido]acetanilide.

Second layer: intermediate gelatin layer containing UV-ray absorber.

Third layer: green-sensitive silver chlorobromide emulsion layer containing 15 mole % of silver chloride and also containing as magenta coupler 1-(2,4,6-trichlorophenyl)-3-(2-chloro-5-octadecenylsuccinimidoanilino)-5-pyrazolone.

Fourth layer: the same intermediate gelatin layer as the second layer.

Fifth layer: red-sensitive silver chlorobromide emulsion layer containing 15 mole % of silver chloride and also containing as cyan coupler 2,4-dichloro-3-methyl-6-[γ-(2,4-diamylphenoxy)butylamido]pheol.

Sixth layer: gelatin protective layer.

The above respective emulsion layers were applied to the total silver quantity of 10 mg/cm$^2$. The silver halide emulsions employed in the respective light-sensitive emulsion layers were applied with chemical sensitization with sodium thiosulfate, respectively and incorporated with conventional additives such as stabilizers, sensitizing dyes, etc. Film hardeners and extenders were also added into the coating solutions for all layers.

The color print paper (in roll) as prepared was picture printed (with brims) and then subjected to continuous replenishing processing by means of a roll automatic developing machine (hereinafter called as autodeveloping running).

| Autodeveloping running steps | Processing temperature (°C.) | Processing time (min.) |
|---|---|---|
| 1. Color developing | 33 ± 0.3 | 3.5 |
| 2. Bleach-fixing | 30 to 34 | 1.5 |
| 3. Water washing | 30 to 34 | 3.5 |
| 4. Drying | 75 to 80 | |

In the above processing steps, for color developing and bleach-fixing, the color developing replenishing solution and the bleach-fixing replenishing solution was each suplemented continuously at a proportion of 325 ml per 1 m$^2$ of the sample processed. The color developing suplementing solution and the color developing solution had the following compositions.

[Color developing replenishing solution]

Benzyl alcohol: 20 ml
Ethyleneglycol: 20 ml
Fluorescent whitener (4,4-diaminostilbenedisulfonic acid derivative): 2.0 g
Hydroxylamine sulfate: 4.0 g
3-methyl-4-amino-N-ethyl-N-(β-methanesulfonamidoethyl)aniline sulfate: 7.0 g
Potassium carbonate: 30 g
1-hydroxyethylidene-1,1-diphosphonic acid (60% solution): 1.1 ml
Potassium sulfite (50% solution): 5 ml
Potassium hydroxide: 3.0 g
(the total amount is made up to one liter and adjusted to pH 10.40 with addition of potassium hydroxide)

[Color developer]

To 800 ml of the above color developing replenishing solution is added a color developing starter as shown below and the total amount was made up to one liter to prepare one liter of a color developer of pH 10.20, and necessary amounts for processing were prepared and employed as desired.

[Color developing starter]

Potassium carbonate: 2.2 g

Potassium hydrogen carbonate: 3.4 g
Potassium bromide: 0.64 g
Potassium chloride: 0.50 g The bleach-fixing and bleach-fixing replenishing solutions had the compositions as follows.

[Bleach-fixing solution and bleach-fixing replenishing solution (1)]

Ethylenediaminetetraacetic acid ammonium iron (III) salt: 70 g
Ethylenediamine tetraacetic acid: 20 g
Ammonium sulfite (50% solution): 30 ml
Ammonium thiosulfate (70% solution): 140 ml
Ammonia water (28% solution): 30 ml
(adjusted to pH 7.0 with ammonia water or acetic acid, and the total amount made up to one liter with addition of water)

[Bleach-fixing solution and bleach-fixing replenishing solution (2)]

Diethylenetriaminepentaacetic acid ammonium iron (III) salt: 80 g
Diethylenetriaminepentaacetic acid: 24 g
Ammonium sulfite (50% solution): 30 ml
Ammonium thiosulfate (70% solution): 140 ml
Ammonia water (28% solution): 30 ml
(adjusted to pH 7.0 with ammonia water and the total amount made up to one liter with addition of water)

Using the bleach-fixing and bleach-fixing replenishing solutions (1) and (2), autodeveloping running was carried out until the amount of the respective bleach-fixing replenishing solutions employed as 2-fold of the tank volume of the bleach-fixing bath. On completion of running, 3 to 5 m of the color print paper was sampled, and after cutting the edge portions with widths of 5 mm wound up firmly in a roll, followed by measurement of the blue reflective density of the edge portion, which was determined as the staining characteristic at the edge portion. The amount of the washing water used during processing was 5 liter/m$^2$ and 200 ml/m$^2$. Further, in order to see the effect of the present invention by the metal ion incorporated, the metal compounds of this invention as indicated in Table 1 were added into the bleach-fixing solution and the bleach-fixing replenishing solution (2) in an amount of 5 g/liter, and evaluation was made similarly as described above. Results are shown in Table 1.

TABLE 1

| Sample No. | Bleach-fixing solution and bleach-fixing replenishing solution | Metal compound (5 g/lit. of Bleach-fixing solution or bleach-fixing replenishing solution) | Blue reflective density (edge staining) Washing water amount 200 ml/m$^2$ | Blue reflective density (edge staining) Washing water amount 5 lit./m2 |
|---|---|---|---|---|
| 1 | (1) Control | — | 0.22 | 0.10 |
| 2 | " | A - 5 | 0.24 | 0.11 |
| 3 | (2) Control | — | 0.43 | 0.20 |
| 4 | (2) Invention | A - 1 | 0.16 | 0.09 |
| 5 | " | A - 5 | 0.15 | 0.08 |
| 6 | " | A - 13 | 0.16 | 0.09 |
| 7 | " | A - 16 | 0.16 | 0.09 |
| 8 | " | A - 17 | 0.17 | 0.10 |
| 9 | " | A - 21 | 0.18 | 0.10 |
| 10 | " | A - 23 | 0.18 | 0.10 |
| 11 | " | A - 75 | 0.16 | 0.09 |
| 12 | " | A - 89 | 0.15 | 0.08 |

As apparently seen from Table 1, the diethylenetriamine pentaacetic acid iron (III) complex salt is very greater in staining at the edge portion, as compared with the ethylenediaminetetraacetic iron (III) complex salt, and its tendency is further pronounced as the amount of washing water is reduced. Also, even when a metal compound (A-5) is added to the ethylenediaminetetraacetic acid iron (III) complex salt, staining at the edge portion is changed little. In contrast, in the bleach-fixing solutions of the present invention (Sample Nos. 4 to 12), as compared with the diethylenetriaminepentaacetic acid iron (III) complex salt (No. 3), staining at the edge portion is prevented to a great extent irrespective of the amount of washing water. It can be appreciated that they have rather better suppressing effect than the ethylenediaminetetraacetic acid iron (III) complex salt.

Processing was also performed by means of a processing apparatus for piece (hereinafter called as manual processing) by changing the pH from 5.0 to 9.0, and the silver elimination completion time, the maximum transmissive red density (cyan dye density) and the minimum reflective green density (magenta stain) were measured. As the result, the results obtained with the use of the bleach-fixing solutions of the present invention (No. 4 to No. 10) containing a metal compound added to diethylenetriaminepentaacetic acid iron (III) complex salt were similar to that of the bleach-fixing solution containing no metal compound (No. 3).

EXAMPLE 2

2000 m$^3$ of Sakura Color II film (produced by Konishiroku Photo Industry, Co.) were photographed by use of Konica FS-1 (produced by Konishiroky Photo Industry, Co.), and then subjected to autodeveloping running.

The automatic developing machine used was prepared by modification of the suspension type film automatic developing machine Type H4-220W-2 (produced by Noritsu Koki Co.).

| Processing step (38° C.) | Number of tank | Processing time |
|---|---|---|
| Color developing | 1 | 3 min. 15 sec. |
| Bleach-fixing | 1 | 8 min. 40 sec. |
| Water washing | 2 | 4 min. 20 sec. |
| Stabilizing | 1 | 2 min. 10 sec. |

The processing solutions employed had the following compositions.

[Color developer]

Potassium carbonate: 30 g
Sodium hydrogen carbonate: 2.5 g
Potassium sulfite: 5 g
Sodium bromide: 1.3 g
Potassium iodide: 2 mg
Hydroxylamine sulfate: 2.5 g
Sodium chloride: 0.6 g
Sodium diethylenetriaminepentaacetate: 2.5 g
4-amino-3-methyl-N-ethyl-N-($\beta$-hydroxyethyl)-aniline sulfate: 4.8 g
Potassium hydroxide: 1.2 g
(made up to one liter with addition of water, and adjusted to pH 10.06 with potassium hydroxide or 20% sulfuric acid)

[Color developing replenishing solution]

Potassium carbonate: 35 g
Sodium hydrogen carbonate: 3 g

Potasium sulfite: 7 g
Sodium bromide: 0.9 g
Hydroxylamine sulfate: 3.1 g
Sodium diethylenetriaminepentaacetate: 3.2 g
4-amino-3-methyl-N-ethyl-N-(β-hydroxyethyl)aniline sulfate: 5.4 g
Potassium hydroxide: 2 g
(made up to one liter with addition of water, and adjusted to pH 10.12 with potassium hydroxide or 20% sulfuric acid)

[Bleach-fixing solution and bleach-fixing replenishing solution (1)]

Ethylenediaminetetraacetic aicd ammonium dihydrate iron (III) salt: 120 g
Ethylenediamine tetraacetic acid: 18 g
Ammonium thiosulfate (70% solution): 300 ml
Ammonium sulfite (40% solution): 40 ml
(adjusted to pH 6.8 with ammonia water and the total amount made up to one liter with addition of water)

[Bleach-fixing solution and bleach-fixing replenishing solution (2)]

Diethylenetriaminepentaacetic acid ammonium iron (III) salt: 142 g
Diethylenetriaminepentaacetic acid: 24 g
Ammonium thiosulfate (70% solution): 300 ml
Ammonium sulfite (40% solution): 40 ml
(adjusted to pH 6.8 with ammonia water and the total amount made up to one liter with addition of water)

[Bleach-fixing solution and bleach-fixing replenishing solution (3)]

Diethylenetriaminepentaacetic acid ammonium iron (III) salt: 142 g
Diethylenetriaminepentaacetic acid: 24 g
Exemplary compound A-5: 8 g
Ammonium thiosulfate (70% solution): 300 ml
Ammonium sulfite (40% solution): 40 ml
(adjusted to pH 6.8 with ammonia water and the total amount made up to one liter with addition of water)

[Stabilizer]

Formalin (35% aqueous solution): 2 ml
Konidax (produced by Konishiroku Photo Industry Co.): 5 ml
(made up to one liter with addition of water)

[Stabilizer replenishing solution]

Formalin (35% aqueous solution): 3 ml
Konidax (produced by Konishiroku Photo Industry Co.): 7 ml
(made up to one liter with addition of water)

The color developing replenishing solution was supplented into the color developing bath in an amount of 15 ml per 100 $cm^2$ of color nega film, the bleach-fixing replenishing solution into the bleach-fixing bath in an amount of 9 ml per 100 $cm^2$ of color nega film, and further the stabilizing replenishing solution into the stabilizing bath in an amount of 11 ml per 100 $cm^2$ of color nega film. Also, into the water washing bath, water was flown in an amount of 150 ml per 100 $cm^2$ of color nega film.

Using the bleach-fixing and bleach-fixing replenishing solutions (1) to (3), the films were processed for the respective length of 2000 m continuously with supplement. After completion of respective autodeveloping running, the bleach-fixing tank solution was sealed with a stopper and stored in a refrigerator. After completion of all the autodeveloping running, the pH of the bleach-fixing tank solutions (1) to (3) was adjusted to the value as indicated in Table 2 and manual processing was carried out. Blue transmissive density (staining degree), silver elimination completion time, namely clearing time, was measured, and further the maximum red density (cyan color density) and minimum green density (magenta stain) of the film obtained after further bleach-fixing processing for 35 minutes was measured, to obtain the results as shown in Table 2, in which, however, results of the blue transmissive density and the clearing time only are shown. As to the blue transmissive density, measurement was made after complete silver elimination so as to be distinguished from the elevation in blue density based on poor silver elimination.

The processing conditions were made the same as in autodeveloping running except for the processing time of bleach-fixing, and the processing solutions employed had the same compositions as those used in autodeveloping running. The samples employed were the Sakura Color II film (produced by Konishiroku Photo Industry Co.), which were cut into pieces and subjected to wedge exposure in a conventional manner.

As a Control, the sample processed by the standard processing of Sakura nega color process CNK-4 was also similarly measured, except that for the silver elimination processing, bleaching processing was carried out for 6 minutes and 30 seconds and the fixing processing for 6 minutes and 30 seconds.

TABLE 2

| | | (pH) | Clearing time | Minimum blue density |
|---|---|---|---|---|
| Bleach-fixing solution (1) | (a) Control | (5.0) | 20 min. | 0.71 |
| | (b) Control | (6.0) | 28 min. | 0.73 |
| | (c) Control | (7.0) | >35 min. | 0.75 |
| | (d) Control | (8.0) | " | 0.77 |
| | (e) Control | (9.0) | " | 0.79 |
| Bleach-fixing solution (2) | (f) Control | (5.0) | 8 min. 30 sec. | 0.76 |
| | (g) Control | (6.0) | " | 0.77 |
| | (h) Control | (7.0) | " | 0.77 |
| | (i) Control | (8.0) | " | 0.78 |
| | (j) Control | (9.0) | 9 min. | 0.79 |
| Bleach-fixing solution (3) | (k) Invention | (5.0) | 8 min. 30 sec. | 0.67 |
| | (l) Invention | (6.0) | " | 0.68 |
| | (m) Invention | (7.0) | " | 0.68 |
| | (n) Invention | (8.0) | " | 0.68 |
| | (o) Invention | (9.0) | 9 min. | 0.69 |

As can be seen from the results in Table 2, in processings using the bleach-fixing solution (3) according to the invention in which the metal compound A-5 is added, the blue density is approximate to the minimum blue density in the standard processing, as compared with the bleach-fixing solution (2) in which no metal compound is added, thus indicating that staining by the diethylenetriaminepentaacetic acid iron (III) complex salt is prevented to a great extent. The clearing time is also free from the influence by addition of the metal compound of the present invention to give good results.

Further, the maximum red density (cyan color density) and the minimum green density (magenta stain) of the film obtained after bleach-fixing processing for 35 minutes, and the days before formation of silver sulfide were observed. As the result, no influence by addition of metal compounds was seen.

EXAMPLE 3

Bleach-fixing solutions were prepared as follows:

[Bleach-fixing solution (1)]

Ethylenediaminetetraacetic acid sodium trihydrate iron (III) salt: 70 g
Ethylenediamine tetraacetic acid: 15 g
Ammonium sulfite (40% solution): 20 ml
Ammonium thiosulfate (70% solution): 140 ml
(adjusted to pH 7.5 with ammonia water and the total amount made up to one liter with addition of water)

[Bleach-fixing solution (2)]

Diethylenetriaminepentaacetic acid ammonium iron (III) salt: 75 g
Ammonium sulfite (40% solution): 20 ml
Ammonium thiosulfate (70% solution): 140 ml
(adjusted to pH 7.5 with ammonia water and the total amount made up to one liter with addition of water)

Further, various chelating agents and metal compounds were added to the bleach-fixing solution (2) to prepare bleach-fixing solutions (3) to (16).

To each of the bleach-fixing solutions (1) to (16) was added 5 g of silver powder per liter of the bleach-fixing solution to convert a part of the iron (III) complex salt to iron (II) complex salt, each 50 ml of the supernatant was placed into a 200 ml beaker and left to stand at 33° C., and the initial air oxidation rate of the respective corresponding iron (II) complex salt was measured by quantitative determination of ethylenediaminetetaacetic iron (III) complex salt and diethylenetriaminepentaacetic acid iron (III) complex salt.

The results are shown in Table 3.

TABLE 3

| Bleach-fixing solution | Metal compound | | Chelating agent | | Initial air oxidation rate constant K ($min^{-1}$) |
|---|---|---|---|---|---|
| | Compound | Amount (g/lit.) | Compound | Amount (g/lit.) | |
| (1) Control | — | — | — | — | $7.43 \times 10^{-3}$ |
| (2) Control | — | — | — | — | $6.34 \times 10^{-4}$ |
| (3) Control | — | — | Diethylenetriaminepentaacetic acid | 6.0 | $6.02 \times 10^{-4}$ |
| (4) Control | A - 5 | 5.0 | Diethylenetriaminepentaacetic acid | 6.0 | $6.03 \times 10^{-4}$ |
| (5) Invention | A - 5 | 5.0 | B - 7 | 6.0 | $1.24 \times 10^{-2}$ |
| (6) Invention | A - 12 | 7.0 | B - 7 | 8.0 | $9.86 \times 10^{-3}$ |
| (7) Invention | A - 16 | 4.0 | B - 7 | 8.0 | $9.71 \times 10^{-3}$ |
| (8) Invention | A - 1 | 6.0 | B - 13 | 9.0 | $9.45 \times 10^{-3}$ |
| (9) Invention | A - 6 | 5.0 | B - 13 | 8.0 | $9.62 \times 10^{-3}$ |
| (10) Invention | A - 17 | 8.0 | B - 13 | 10.0 | $1.01 \times 10^{-2}$ |
| (11) Invention | A - 4 | 6.0 | B - 14 | 10.0 | $1.18 \times 10^{-2}$ |
| (12) Invention | A - 12 | 5.0 | B - 14<br>B - 14 | 9.0<br>12.0 | $9.56 \times 10^{-3}$ |
| (13) Invention | A - 16 | 10.0 | Diethylenetriaminepentaacetic acid | 6.0 | $9.32 \times 10^{-3}$ |
| (14) Invention | A - 7 | 8.0 | B - 17 | 14.0 | $9.27 \times 10^{-3}$ |
| (15) Invention | A - 13 | 7.0 | B - 17 | 18.0 | $9.25 \times 10^{-3}$ |
| (16) Invention | A - 18 | 10.0 | B - 17 | 20.0 | $9.26 \times 10^{-3}$ |

From the results in Table 3, it can be seen that a diethylenetriaminepentaacetic acid iron (II) complex salt is generally very slow in air oxidation speed as compared with an ethylenediaminetetraacetic acid iron (II) complex salt. In contrast, it can be appreciated that the bleach-fixing solution of the present invention has a higher initial air oxidation rate constant than an ethylenediaminetetraacetic acid iron (II) complex salt.

Next, bleaching solutions (1) to (16) were prepared by adding 140 g/liter of ammonium bromide in place of ammonium sulfite and ammonium thiosulfate in bleach-fixing solutions (1) to (16) and adjusting pH to 6.5, and the initial air oxidation rate constants were measured by using these solutions. Substantially the same results were obtained.

EXAMPLE 4

After 1000 $m^2$ of Sakura Color II film (produced by Konishiroku Photo Industry, Co.) were photographed by use of Konica FS-1 (produced by Konishiroky Photo Industry, Co.), continuous replenishing processings were carried out by means of an automatic developing machine according to the following processing steps (hereinafter called as autodeveloping running).

The automatic developing machine used was prepared by modification of the suspension type film automatic developing machine Type H4-220W-2 (produced by Noritsu Koki Co.).

| Processing step (38° C.) | Number of tank | Processing time |
|---|---|---|
| Color developing | 1 | 3 min. 15 sec. |
| Bleach-fixing | 1 | 8 min. 40 sec. |
| Water washing | 2 | 4 min. 20 sec. |
| Stabilizing | 1 | 2 min. 10 sec. |

The processing solutions employed had the following compositions.

[Color developer]

Potassium carbonate: 30 g
Sodium hydrogen carbonate: 2.5 g
Potassium sulfite: 5 g
Sodium bromide: 1.3 g
Potassium iodide: 2 mg
Hydroxylamine sulfate: 2.5 g
Sodium chloride: 0.6 g
Potassium bromide: 1.2 g
Sodium diethylenetriaminepentaacetate: 2.5 g
4-amino-3-methyl-N-ethyl-N-(β-hydroxyethyl)aniline sulfate: 4.8 g
Potassium hydroxide: 1.2 g
(made up to one liter with addition of water, and adjusted to pH 10.06 with potassium hydroxide or 20% sulfuric acid)

[Color developer replenishing solution]

Potassium carbonate: 35 g
Sodium hydrogen carbonate: 3 g
Potasium sulfite: 7 g
Sodium bromide: 0.9 g
Hydroxylamine sulfate: 3.1 g
Sodium diethylenetriaminepentaacetate: 3.2 g
4-amino-3-methyl-N-ethyl-N-(β-hydroxyethyl)aniline sulfate: 5.4 g
Potassium hydroxide: 2 g
(made up to one liter with addition of water, and adjusted to pH 10.12 with potassium hydroxide or 20% sulfuric acid)

[Bleach-fixing solution and bleach-fixing replenishing solution (1)]

Ethylenediaminetetraacetic acid ammonium dihydrate iron (III) salt: 120 g
Ethylenediamine tetraacetic acid: 18 g
Ammonium thiosulfate (70% solution): 300 ml
Ammonium sulfite (40% solution): 40 ml
(adjusted to pH 6.8 with ammonia water and the total amount made up to one liter with addition of water)

[Bleach-fixing solution and bleach-fixing replenishing solution (2)]

Diethylenetriaminepentaacetic acid ammonium iron (III) salt: 145 g
Diethylenetriaminepentaacetic acid: 24 g
Ammonium thiosulfate (70% solution): 300 ml
Ammonium sulfite (40% solution): 40 ml
(adjusted to pH 6.8 with ammonia water and the total amount made up to one liter with addition of water)

[Bleach-fixing solution and bleach-fixing replenishing solution (3)]

Diethylenetriaminepentaacetic acid ammonium iron (III) salt: 145 g
Exemplary compound A-5: 5 g
Exemplary compound B-7: 5 g
Ammonium thiosulfate (70% solution): 300 ml
Ammonium sulfite (40% solution): 40 ml
(adjusted to pH 6.8 with ammonia water and the total amount made up to one liter with addition of water)

[Bleach-fixing solution and bleach-fixing replenishing solution (4)]

Diethylenetriaminepentaacetic acid ammonium iron (III) salt: 145 g
Exemplary compound A-6: 6 g
Exemplary compound B-13: 7 g
Diethylenetriaminetetraacetic acid: 5 g
Ammonium thiosulfate (70% solution): 300 ml
Ammonium sulfite (40% solution): 40 ml
(adjusted to pH 6.8 with ammonia water and the total amount made up to one liter with addition of water)

[Bleach-fixing solution and bleach-fixing replenishing solution (5)]

Diethylenetriaminepentaacetic acid ammonium iron (III) salt: 145 g
Exemplary compound A-12: 8 g
Exemplary compound B-17: 15 g
Ammonium thiosulfate (70% solution): 300 ml
Ammonium sulfite (40% solution): 40 ml
(adjusted to pH 6.8 with ammonia water and the total amount made up to one liter with addition of water)

[Stabilizer]

Formalin (35% aqueous solution): 2 ml
Konidax (produced by Konishiroku Photo Industry Co.): 5 ml
(made up to one liter with addition of water)

[Stabilizer replenishing solution]

Formalin (35% aqueous solution): 3 ml
Konidax (produced by Konishiroku Photo Industry Co.): 7 ml
(made up to one liter with addition of water)

The color devloping replenishing solution was supplemented into the color developing bath in an amount of 15 ml per 100 $cm^2$ of color nega film, the bleach-fixing replenishing solution into the bleach-fixing bath in an amount of 9 ml per 100 $cm^2$ of color nega film, and further the stabilizing replenishing solution into the stabilizing bath in an amount of 11 ml per 100 $cm^2$ of color nega film. Also, into the water washing bath, water was flown in an amount of 150 ml per 100 $cm^2$ of color nega film.

Using the bleach-fixing and bleach-fixing replenishing solutions (1) to (5), the films were processed for the respective length of 1000 m continuously with supplement. After completion of respective autodeveloping running, the bleach-fixing tank solution was sealed with a stopper and stored in a refrigerator. After completion of all the autodeveloping running, the pH of the bleach-fixing tank solutions (1) to (5) was adjusted to the value as indicated in Table 4 and processed by means of a processing apparatus for piece (hereinafter called as manual developing), and silver elimination completion time, namely clearing time, was measured, and further the maximum red density (cyan color density) of the film obtained after further bleach-fixing processing for 30 minutes was measured, to obtain the results as shown in Table 4.

The processing conditions were made the same as in autodeveloping running except for the processing time of bleach-fixing, and the processing solutions employed had the same composition as those used in autodeveloping running. The samples employed were the same kind of film employed in autodeveloping running, which were cut into pieces and subjected to wedge exposure in a conventonal manner.

As a Control, the sample processed by the standard processing of Sakura nega color process CNK-4 was also similarly measured, except that for the silver elimination processing, bleaching processing was carried out for 6 minutes and 30 seconds and the fixing processing for 6 minutes and 30 seconds.

TABLE 4

| | | (pH) | Clearing time | Maximum red density |
|---|---|---|---|---|
| Bleach-fixing solution (1) | (a) Control | (5.0) | 18 min. 30 sec. | 2.15 |
| | (b) Control | (6.0) | 24 min. 30 sec. | 2.43 |
| | (c) Control | (7.0) | >30 min. | 3.35 |
| | (d) Control | (8.0) | " | 3.39 |
| | (e) Control | (9.0) | " | 3.40 |
| Bleach-fixing solution (2) | (f) Control | (5.0) | 12 min. | 2.40 |
| | (g) Control | (6.0) | " | 2.46 |
| | (h) Control | (7.0) | " | 2.46 |
| | (i) Control | (8.0) | " | 2.46 |
| | (j) Control | (9.0) | 13 min. | 2.46 |
| Bleach-fixing solution (3) | (k) Invention | (5.0) | 8 min. 30 sec. | 2.60 |
| | (l) Invention | (6.0) | " | 2.64 |
| | (m) Invention | (7.0) | " | 2.64 |
| | (n) Invention | (8.0) | " | 2.64 |

TABLE 4-continued

| | | (pH) | Clearing time | Maximum red density |
|---|---|---|---|---|
| | (o) Invention | (9.0) | 9 min. | 2.64 |
| Bleach- | (p) Invention | (5.0) | 8 min. 30 sec. | 2.58 |
| fixing | (q) Invention | (6.0) | " | 2.63 |
| solution | (r) Invention | (7.0) | " | 2.63 |
| (4) | (s) Invention | (8.0) | " | 2.63 |
| | (t) Invention | (9.0) | 9 min. | 2.64 |
| Bleach- | (u) Invention | (5.0) | 8 min. 30 sec. | 2.55 |
| fixing | (v) Invention | (6.0) | " | 2.62 |
| solution | (w) Invention | (7.0) | " | 2.62 |
| (5) | (x) Invention | (8.0) | " | 2.62 |
| | (y) Invention | (9.0) | 9 min. | 2.62 |

As can be seen from the results in Table 4, in processings using the bleach-fixing solutions (3) to (5) according to the invention were employed, clearing time was short and the maximum red density coincides substantially with 2.63 of the standard processing, being substantially without problem. On the other hand, in the case of the bleach-fixing solutions (1) and (2) outside the scope of the present invention, both clearing time and the maximum red density are not satisfactory.

EXAMPLE 5

On a paper support coated on its surface with a polyethylene layer containing an anatase type titanium dioxide as the white pigment, pre-treatment was applied by corona discharging and the respective layers as shown below were successively provided by coating to prepare a color print paper.

First layer: blue-sensitive silver chlorobromide emulsion containing 5 mole % of silver chloride and also containing as yellow coupler α-[4-(1-benzyl-2-phenyl-3,5-dioxo-1,2,4-triazolidyl)]-α-pivalyl-2-chloro-5-[γ-(2,4-di-t-amylphenoxy)butylamido]acetanilide.

Second layer: intermediate gelatin layer containing UV-ray absorber.

Third layer: green-sensitive silver chlorobromide emulsion layer containing 15 mole % of silver chloride and also containing as magenta coupler 1-(2,4,6-trichlorophenyl)-3-(2-chloro-5-octadecenylsuccinimidoanilino)-5-pyrazolone.

Fourth layer: the same intermediate gelatin layer as the second layer.

Fifth layer: Red-sensitive silver chlorobromide emulsion layer containing 15 mole % of silver chloride and also containing as cyan coupler 2,4-dichloro-3-methyl-6-[γ-(2,4-diamylphenoxy)butylamido]phenol.

Sixth layer: gelatin protective layer.

The above respective emulsion layers were applied to the total silver quantity of 10 mg per 100 $cm^2$. The silver halide emulsions employed in the respective light-sensitive emulsion layers were applied with chemical sensitization with sodium thiosulfate, respectively and incorporated with conventional additives such as stabilizers, sensitizing dyes, etc. Film hardeners and extenders were also added into the coating solutions for all layers.

The color print paper (in roll) as prepared was picture printed and then subjected to autodeveloping running by means of a roll automatic developing machine.

[Standard processing steps]

| | | |
|---|---|---|
| Color developing | 33° C. | 3 min. 30 sec. |
| Bleaching | 33° C. | 1 min. |
| Fixing | 33° C. | 1 min. |

-continued

| | | |
|---|---|---|
| Water washing | 30 to 35° C. | 3 min. |
| Drying | 75 to 80° C. | about 2 min. |

The processing solutions had the follosing compositions.

[Color developer]

Benzyl alcohol: 15 ml
Ethyleneglycol: 15 ml
Potassium sulfite: 2.0 g
Potassium bromide: 0.7 g
Sodium chloride: 0.2 g
Potassium carbonate: 30.0 g
Hydroxylamine sulfate: 3.0 g
Polyphosphoric acid (TPPS): 2.5 g
3-methyl-4-amino-N-ethyl-N-(β-methanesulfonamidoethyl)aniline sulfate: 5.5 g
Fluorescent whitener (4,4-diaminostilbenedisulfonic acid derivative): 1.0 g
Potassium hydroxide: 2.0 g
(made up to one liter with addition of water).

[Color developing replenishing solution]

Benzyl alcohol: 20 ml
Ethyleneglycol: 20 ml
Potassium sulfite: 3.0 g
Potassium carbonate: 30.0 g
Hydroxylamine sulfate: 4.0 g
Polyphosphoric acid (TPPS): 3.0 g
3-methyl-4-amino-N-ethyl-N-(β-methanesulfonamidoethyl)aniline sulfate: 7.0 g
Fluorescent whitener (4,4-diaminostilbenedisulfonic acid derivative): 1.5 g
Potassium hydroxide: 3.0 g
(made up to one liter with addition of water)

[Bleaching solution and bleaching replenishing solution (1)]

Ethylenediaminetetraacetic acid ammonium dihydrate iron (III) salt: 70 g
Ethylenediaminetetraacetic acid: 10 g
Ammonium bromide: 80 g
(adjusted to pH 6.2 with ammonia water and the total amount made up to one liter with addition of water).

[Bleaching solution and bleaching replenishing solution (2)]

Diethylenetriaminepentaacetic acid ammonium iron (III) salt: 87 g
Diethylenetriaminepentaacetic acid: 13 g
Ammonium bromide: 80 g
(adjusted to pH 6.2 with ammonia water and the total amount made up to one liter with addition of water).

[Bleaching solution and bleaching replenishing solution (3)]

Diethylenetriaminepentaacetic acid ammonium iron (III) salt: 87 g
Exemplary compound A-5: 8 g
Exemplary compound B-7: 8 g
Ammonium bromide: 80 g
(adjusted to pH 6.2 with ammonia water and the total amount made up to one liter with addition of water).

[Bleach-ing solution and bleaching replenishing solution (4)]

Diethylenetriaminepentaacetic acid ammonium iron (III) salt: 87 g
Exemplary compound A-7: 9 g
Exemplary compound B-13: 9 g
Diethylenetriaminepentaacetic acid: 5 g
Ammonium bromide: 80 g
(adjusted to pH 6.2 with ammonia water and the total amount made up to one liter with addition of water).

[Bleaching solution and bleaching replenishing solution (5)]

Diethylenetriaminepentaacetic acid ammonium iron (III) salt: 87 g
Exemplary compound A-13: 10 g
Exemplary compound B-14: 10 g
Ammonium bromide: 80 g
(adjusted to pH 6.2 with ammonia water and the total amount made up to one liter with addition of water).

[Fixing solution]

Ammonium thiosulfate (70% solution): 120 ml
Ammonium sulfite (40% solution): 25 ml
(adjusted to pH 6.5 with ammonia water and the total amount made up to one liter with addition of water).

[Fixing replenishing solution]

Ammonium thiosulfate (70% solution): 240 ml
Ammonium sulfite (40% solution): 50 ml
(adjusted to pH 6.5 with ammonia water and the total amount made up to one liter with addition of water).

The color developing replenishing solution and the bleaching replenishing solution were each supplemented into the color developing bath in an amount of 3.2 ml per 100 $cm^2$ of color print paper, the fixing replenishing solution in an amount of 0.7 ml per 100 $cm^2$ of color print paper, and into the water washing bath, water was flown in an amount of 100 ml per 100 $cm^2$ of color print paper. Also, by controlling the squeeze before and after the bleaching bath and the fixing bath, the amount of take-in and pick-up of the solution per 100 $cm^2$ of color print paper was adjusted to 0.5 ml.

Using the bleaching and bleaching replenishing solutions (1) to (5), autodeveloping running was carried out until the amount of each bleaching replenishing solution became 4-fold of the tank volume of the bleaching bath. After completion of respective autodeveloping running, the bleaching tank solution was sealed with a stopper and stored in a refrigerator. After completion of all the autodeveloping running, the pH of the bleaching tank solutions (1) to (5) was adjusted to the value as indicated in Table 5 and manual processing was carried out. Silver elimination completion time, namely clearing time, was measured, and further the maximum red transmissive density (cyan color density) of the color print paper obtained after further bleaching processing for 2 minutes was measured, to obtain the results as shown in Table 5.

The processing conditions were made the same as in autodeveloping running except for the processing time of bleach-fixing, and the processing solutions employed hadthe same composition as those used in autodeveloping running. The samples employed were the same kind of film employed in autodeveloping running, which were cut into pieces and subjected to wedge exposure in a conventonal manner.

TABLE 5

| | | (pH) | Clearing time | Maximum transmissive red density |
|---|---|---|---|---|
| Bleaching solution (1) | (a) Control | (5.0) | 45 sec. | 2.30 |
| | (b) Control | (6.0) | 55 sec. | 2.46 |
| | (c) Control | (7.0) | 1 min. 20 sec. | 2.50 |
| | (d) Control | (8.0) | 1 min. 30 sec. | 2.52 |
| | (e) Control | (9.0) | >2 min. | 2.54 |
| Bleaching solution (2) | (f) Control | (5.0) | 53 sec. | 2.33 |
| | (g) Control | (6.0) | " | 2.40 |
| | (h) Control | (7.0) | " | 2.43 |
| | (i) Control | (8.0) | " | 2.44 |
| | (j) Control | (9.0) | 55 sec. | 2.44 |
| Bleaching solution (3) | (k) Invention | (5.0) | 33 sec. | 2.48 |
| | (l) Invention | (6.0) | 34 sec. | 2.54 |
| | (m) Invention | (7.0) | " | 2.55 |
| | (n) Invention | (8.0) | 35 sec. | 2.55 |
| | (o) Invention | (9.0) | " | 2.55 |
| Bleaching solution (4) | (p) Invention | (5.0) | 35 sec. | 2.49 |
| | (q) Invention | (6.0) | 36 sec. | 2.52 |
| | (r) Invention | (7.0) | " | 2.52 |
| | (s) Invention | (8.0) | " | 2.52 |
| | (t) Invention | (9.0) | " | 2.54 |
| Bleaching solution (5) | (u) Invention | (5.0) | 35 sec. | 2.48 |
| | (v) Invention | (6.0) | " | 2.53 |
| | (w) Invention | (7.0) | 36 sec. | 2.53 |
| | (x) Invention | (8.0) | " | 2.53 |
| | (y) Invention | (9.0) | " | 2.54 |

As can be seen from the results in Table 5, in processings using the bleaching solutions according to the invention (3), (4) and (5) were employed, clearing time was short and the maximum transmissive red density is high, thus exhibiting very good performance. On the other hand, in the case of the bleaching solutions (1) and (2) outside the scope of the present invention, both clearing time and the maximum red density are not satisfactory.

EXAMPLE 6

On a paper support coated on its surface with a polyethylene layer containing an anatase type titanium dioxide as the white pigment, pre-treatment was applied by corona discharging and the respective layers as shown below were successively provided by coating to prepare a color print paper.

First layer: blue-sensitive silver chlorobromide emulsion containing 5 mole % of silver chloride and also containing as yellow coupler α-[4-(1-benzyl-2-phenyl-3,5-dioxo-1,2,4-triazolidyl)]-α-pivalyl-2-chloro-5-[γ-(2,4-di-t-amylphenoxy)butylamido]acetanilide.

Second layer: intermediate gelatin layer containing UV-ray absorber.

Third layer: green-sensitive silver chlorobromide emulsion layer containing 15 mole % of silver chloride and also containing as magenta coupler 1-(2,4,6-trichlorophenyl)-3-(2-chloro-5-octadecenylsuccinimidoanilino)-5-pyrazolone.

Fourth layer: the same intermediate gelatin layer as the second layer.

Fifth layer: red-sensitive silver chlorobromide emulsion layer containing 15 mole % of silver chloride and also containing as cyan coupler 2,4-dichloro-3-methyl-6-[γ-(2,4-diamylphenoxy)butylamido]pheol.

Sixth layer: gelatin protective layer.

The above respective emulsion layers were applied to the total silver quantity of 10 mg/$cm^2$. The silver halide emulsions employed in the respective light-sensitive emulsion layers were applied with chemical sensitization with sodium thiosulfate, respectively and incorporated with conventional additives such as stabilizers, sensitizing dyes, etc. Film hardeners and extenders were also added into the coating solutions for all layers.

The color print paper (in roll) as prepared was picture printed (with brims) and then subjected to continuous replenishing processing by means of a roll automatic developing machine (hereinafter called as autodeveloping running).

| Autodeveloping running steps | Processing temperature (°C.) | Processing time (min.) |
|---|---|---|
| 1. Color developing | 33 ± 0.3 | 3.5 |
| 2. Bleach-fixing | 30 to 34 | 1.5 |
| 3. Water washing | 30 to 34 | 3.5 |
| 4. Drying | 75 to 80 | |

In the above processing steps, for color developing and bleach-fixing, the color developing replenishing solution and the bleach-fixing replenishing solution was each suplemented continuously at a proportion of 325 ml per 1 $m^2$ of the sample processed. The color developing suplementing solution and the color developing solution had the following compositions.

[Color developing replenishing solution]

Benzyl alcohol: 20 ml
Ethyleneglycol: 20 ml
Fluorescent whitener (4,4-diaminostilbenedisulfonic acid derivative): 2.0 g
Hydroxylamine sulfate: 4.0 g
3-methyl-4-amino-N-ethyl-N-(β-methanesulfonamidoethyl)aniline sulfate: 7.0 g
Potassium carbonate: 30 g
1-hydroxyethylidene-1,1-diphosphonic acid (60% solution): 1.1 ml
Potassium sulfite (50% solution): 5 ml
Potassium hydroxide: 3.0 g
(the total amount is made up to one liter and adjusted to pH 10.40 with addition of potassium hydroxide).

[Color developer]

To 800 ml of the above color developing replenishing solution is added a color developing starter as shown below and the total amount was made up to one liter to prepare one liter of a color developer of pH 10.20, and necessary amounts for processing were prepared and employed as desired.

[Color developing starter]

Potassium carbonate: 2.2 g
Potassium hydrogen carbonate: 3.4 g
Potassium bromide: 0.64 g
Potassium chloride: 0.50 g The bleach-fixing and bleach-fixing replenishing solutions had the compositions as follows.

[Bleach-fixing solution and bleach-fixing replenishing solution (1)]

Ethylenediaminetetraacetic acid ammonium iron (III) salt: 70 g
Ethylenediamine tetraacetic acid: 20 g
Ammonium sulfite (50% solution): 30 ml
Ammonium thiosulfate (70% solution): 140 ml
Ammonia water (28% solution): 30 ml
(adjusted to pH 7.0 with ammonia water or acetic acid, and the total amount made up to one liter with addition of water).

[Bleach-fixing solution and bleach-fixing replenishing solution (2)]

Diethylenetriaminepentaacetic acid ammonium iron (III) salt: 80 g
Diethylenetriaminepentaacetic acid: 24 g
Ammonium sulfite (50% solution): 30 ml
Ammonium thiosulfate (70% solution): 140 ml
Ammonia water (28% solution) 30 ml
(adjusted to pH 7.0 with ammonia water and the total amount made up to one liter with addition of water)

Using the bleach-fixing and bleach-fixing replenishing solutions (1) and (2), autodeveloping running was carried out until the amount of the respective bleach-fixing replenishing solutions employed is 2-fold of the tank volume of the bleach-fixing bath. On completion of running, 3 to 5 m of the color print paper was sampled, and after cutting the edge portions with widths of 5 mm wound up firmly in a roll, followed by measurement of the blue reflective density of the edge portion, which was determined as the staining characteristic at the edge portion. The amount of the washing water used during processing was 7 liter/$m^2$ and 300 ml/$m^2$. Further, in order to see the effect of the present invention by the metal ion incorporated, the metal compounds of this invention as indicated in Table 6 were added into the bleach-fixing solution and the bleach-fixing replenishing solution (2) in an amount of 6 g/liter, and evaluation was made similarly as described above. Results are shown in Table 6.

TABLE 6

| Sample No. | Bleach-fixing solution and bleach-fixing replenishing solution | Metal compound (6 g/lit. of Bleach-fixing solution or bleach-fixing replenishing solution) | Blue reflective density (edge staining) Washing water amount 300 ml/$m^2$ | Blue reflective density (edge staining) Washing water amount 7 lit./m2 |
|---|---|---|---|---|
| 1 | (1) Control | — | 0.20 | 0.09 |
| 2 | " | A - 30 | 0.23 | 0.10 |
| 3 | (2) Control | — | 0.42 | 0.19 |
| 4 | (2) Invention | A - 30 | 0.16 | 0.08 |
| 5 | " | A - 38 | 0.15 | 0.08 |
| 6 | " | A - 43 | 0.14 | 0.09 |
| 7 | " | A - 48 | 0.15 | 0.09 |
| 8 | " | A - 52 | 0.15 | 0.10 |
| 9 | " | A - 55 | 0.15 | 0.10 |
| 10 | " | A - 58 | 0.16 | 0.09 |
| 11 | " | A - 59 | 0.16 | 0.09 |
| 12 | " | A - 61 | 0.17 | 0.10 |
| 13 | " | A - 67 | 0.17 | 0.10 |

As apparently seen from Table 6, the diethylenetriamine pentaacetic acid iron (III) complex salt is very greater in staining at the edge portion, as compared with the ethylenediaminetetraacetic iron (III) complex salt, and its tendency is further pronounced as the amount of washing water is reduced. Also, even when a metal compound (A-30) is added to the ethylenediaminetetraacetic acid iron (III) complex salt, staining at the edge portion is changed little. In contrast, in the bleach-fixing solutions of the present invention (Sample Nos. 4 to 13), as compared with the diethylenetriaminepentaacetic acid iron (III) complex salt (No. 3), staining at the edge portion is prevented to a great extent irrespective of the amount of washing water. It can be appreciated that they have rather better suppressing effect than the ethylenediaminetetraacetic acid iron (III) complex salt.

Processing was also performed by means of a processing apparatus for piece (hereinafter called as manual processing) by changing the pH from 5.0 to 9.0, and the silver elimination completion time, the maximum transmissive red density (cyan dye density) and the minium reflective green density (magenta stain) were measured. As the result, the results obtained with the use of the bleach-fixing solutions of the present invention (No. 4 to No. 13) containing a metal compound added to diethylenetriaminepentaacetic acid iron (III) complex salt were similar to that of the bleach-fixing solution containing no metal compound (No.3).

EXAMPLE 7

1500 $m^3$ of Sakura Color II film (produced by Konishiroku Photo Industry, Co.) were photographed by use of Konica FS-1 (produced by Kanishiroku Photo Industry, Co.), and then subjected to autodeveloping running.

The automatic developing machine used was prepared by modification of the suspension type automatic film developing machine Type H4-220W-2 (produced by Noritsu Koki Co.).

| Processing step (38° C.) | Number of tank | Processing time |
|---|---|---|
| Color developing | 1 | 3 min. 15 sec. |
| Bleach-fixing | 1 | 8 min. 40 sec. |
| Water washing | 2 | 4 min. 20 sec. |
| Stabilizing | 1 | 2 min. 10 sec. |

The processing solutions employed had the following compositions.

[Color developer]

Potassium carbonate: 30 g
Sodium hydrogen carbonate: 2.5 g
Potasium sulfite: 5 g
Sodium bromide: 1.3 g
Potassium iodide: 2 mg
Hydroxylamine sulfate: 2.5 g
Sodium chloride: 0.6 g
Sodium diethylenetriaminepentaacetate: 2.5 g
4-amino-3-methyl-N-ethyl-N-(β-hydroxyethyl)-aniline sulfate: 4.8 g
Potassium hydroxide: 1.2 g
(made up to one liter with addition of water, and adjusted to pH 10.06 with potassium hydroxide or 20% sulfuric acid).

[Color developing replenishing solution]

Potassium carbonate: 35 g
Sodium hydrogen carbonate: 3 g
Potasium sulfite: 7 g
Sodium bromide: 0.9 g
Hydroxylamine sulfate: 3.1 g
Sodium diethylenetriaminepentaacetate: 3.2 g
4-amino-3-methyl-N-ethyl-N-(β-hydroxyethyl)-aniline sulfate: 5.4 g
Potassium hydroxide: 2 g
(made up to one liter with addition of water, and adjusted to pH 10.12 with potassium hydroxide or 20% sulfuric acid).

[Bleach-fixing solution and bleach-fixing replenishing solution (1)]

Ethylenediaminetetraacetic aicd ammonium dihydrate iron (III) salt: 120 g
Ethylenediamine tetraacetic acid: 18 g
Ammonium thiosulfate (70% solution): 300 ml
Ammonium sulfite (40% solution): 40 ml
(adjusted to pH 6.8 with ammonia water and the total amount made up to one liter with addition of water).

[Bleach-fixing solution and bleach-fixing replenishing solution (2)]

Diethylenetriaminepentaacetic acid ammonium iron (III) salt: 142 g
Diethylenetriaminepentaacetic acid: 24 g
Ammonium thiosulfate (70% solution): 300 ml
Ammonium sulfite (40% solution): 40 ml
(adjusted to pH 6.8 with ammonia water and the total amount made up to one liter with addition of water).

[Bleach-fixing solution and bleach-fixing replenishing solution (3)]

Diethylenetriaminepentaacetic acid ammonium iron (III) salt: 142 g
Diethylenetriaminepentaacetic acid: 24 g
Exemplary compound A-76: 7 g
Ammonium thiosulfate (70% solution): 300 ml
Ammonium sulfite (40% solution): 40 ml
(adjusted to pH 6.8 with ammonia water and the total amount made up to one liter with addition of water).

[Stabilizer]

Formalin (35% aqueous solution): 2 ml
Konidax (produced by Konishiroku Photo Industry Co.): 5 ml
(made up to one liter with addition of water).

[Stabilizer replenishing solution]

Formalin (35% aqueous solution): 3 ml
Konidax (produced by Konishiroku Photo Industry Co.): 7 ml
(made up to one liter with addition of water)

The color developing replenishing solution was supplented into the color developing bath in an amount of 15 ml per 100 $cm^2$ of color nega film, the bleach-fixing replenishing solution into the bleach-fixing bath in an amount of 9 ml per 100 $cm^2$ of color nega film, and further the stabilizing replenishing solution into the stabilizing bath in an amount of 11 ml per 100 $cm^2$ of color nega film. Also, into the water washing bath, water was flown in an amount of 30 ml per 100 $cm^2$ of color nega film.

Using the bleach-fixing and bleach-fixing replenishing solutions (1) to (3), the films were processed for the respective length of 1500 m continuously with supplement. After completion of respective autodeveloping running, the bleach-fixing tank solution was sealed with a stopper and stored in a refrigerator. After completion of all the autodeveloping running, the pH of the bleach-fixing tank solutions (1) to (3) was adjusted to the value as indicated in Table 7 and manual processing was carried out. Blue transmissive density (staining degree), silver elimination completion time, namely clearing time, was measured, and further the maximum red density (cyan color density) and minimum green density (magenta stain) of the film obtained after further bleach-fixing processing for 35 minutes was measured, to obtain the results as shown in Table 2, in which, however, results of the blue transmissive density and the clearing time only are shown. As to the blue transmissive density, measurement was made after complete silver elimination so as to be distinguished from the elevation in blue density based on poor silver elimination.

The processing conditions were made the same as in autodeveloping running except for the processing time of bleach-fixing, and the processing solutions employed had the same compositions as those used in autodeveloping running. The samples employed were the Sakura Color II film (produced by Konishiroku Photo Industry Co.), which were cut into pieces and subjected to wedge exposure in a conventional manner.

As a Control, the sample processed by the standard processing of Sakura nega color process CNK-4 was also similarly measured, except that for the silver elimination processing, bleaching processing was carried out for 6 minutes and 30 seconds and the fixing processing for 6 minutes and 30 seconds.

TABLE 7

| | | (pH) | Clearing time | Minimum blue density |
|---|---|---|---|---|
| Bleach-fixing solution (1) | (a) Control | (5.0) | 20 min. | 0.78 |
| | (b) Control | (6.0) | 28 min. | 0.80 |
| | (c) Control | (7.0) | >35 min. | 0.83 |
| | (d) Control | (8.0) | " | 0.85 |
| | (e) Control | (9.0) | " | 0.86 |
| Bleach-fixing solution (2) | (f) Control | (5.0) | 8 min. 30 sec. | 0.90 |
| | (g) Control | (6.0) | " | 0.91 |
| | (h) Control | (7.0) | " | 0.91 |
| | (i) Control | (8.0) | " | 0.92 |
| | (j) Control | (9.0) | 9 min. | 0.92 |
| Bleach-fixing solution (3) | (k) Invention | (5.0) | 8 min. 30 sec. | 0.68 |
| | (l) Invention | (6.0) | " | 0.68 |
| | (m) Invention | (7.0) | " | 0.69 |
| | (n) Invention | (8.0) | " | 0.69 |
| | (o) Invention | (9.0) | 9 min. | 0.70 |

As can be seen from the results in Table 7, in processings using the bleach-fixing solution (3) according to the invention in which the metal compound A-76 is added, the blue density is approximate to the minimum blue density in the standard processing, as compared with the bleach-fixing solution (2) in which no metal compound is added, thus indicating that staining by the diethylenetriaminepentaacetic acid iron (III) complex salt is prevented to a great extent. The clearing time is also free from the influence by addition of the metal compound of the present invention to give good results.

Further, the maximum red density (cyan color density) and the minimum green density (magenta stain) of the film obtained after bleach-fixing processing for 35 minutes, and the days before formation of silver sulfide were observed. As the result, no influence by addition of metal compounds was seen.

We claim:

1. A processing solution having bleaching ability for light-sensitive silver halide photographic material, which comprises; an oxidizing agent comprising a diethylenetriaminepentaacetic acid iron (III) complex salt; and at least one metal ion selected from the group consisting of nickel, cobalt, zinc, cerium, ruthenium, yttrium, samarium, magnesium, calcium, bismuth, strontium, manganese, aluminum, tin, barium, indium, thallium and zirconium; and a chelating agent other then diethylenetriaminepentaacetic acid or salt thereof.

2. The processing solution according to claim 1, wherein the solution has pH of from 3 to 9.5.

3. The processing solution according to claim 2, wherein the solution has pH of from 4 to 9.5.

4. The processing solution according to claim 1, wherein the solution is a bleach-fixing solution.

5. The processing solution according to claim 1, wherein said chelating agent is in an amount of from 0.0001 mole to 2 moles per liter of the solution.

6. The processing solution according to claim 5, wherein said chelating agent is in an amount of from 0.001 mole to 2 moles per liter of the solution.

7. The processing solution according to claim 1, wherein a compound supplying said metal ion is selected from the group consisting of zinc chloride, zinc bromide, zinc sulfate, zinc nitrate, nickel chloride, nickel nitrate, nickel sulfate, nickel acetate, nickel bromide, nickel iodide, nickel phosphate, cobalt chloride, cobalt nitrate, cobalt sulfate, cobalt acetate, cerium sulfate, ruthenium sulfate, ruthenium chloride, yttrium sulfate, yttrium nitrate, yttrium chloride, yttrium fluoride, samarium chloride, samarium bromide, samarium sulfate, samarium carbonate, samarium nitrate and samarium acetate.

8. The processing solution according to claim 1, wherein said diethylenetriaminepentaacetic acid iron (III) complex salt is in an amount of 0.01 mole to 2 moles per liter of the solution.

9. The processing solution according to claim 1, wherein said metal ion is selected from the group consisting of nickel, cobalt, cerium, magnesium, calcium, bismuth, strontium, manganese, aluminum, tin and barium.

10. The processing solution according to claim 1, wherein said metal ion is selected from the group consisting of cerium, magnesium, calcium, bismuth, strontium, manganese, aluminum, tin and barium.

11. A processing solution having bleaching ability for light-sensitive silver halide photographic material, which comprises; an oxidizing agent comprising a diethylenetriaminepentaacetic acid iron (III) complex salt; and at least one metal ion selected from the group consisting of nickel, cobalt, zinc, cerium, ruthenium, yttrium, samarium, magnesium, calcium, bismuth, strontium, manganese, aluminum, tin, barium, indium, thallium and zirconium; and a chelating agent selected from the group consisting of dicarboxylic acid, polycarboxylic acid, oxycarboxylic acid, aminocarboxylic acid other than diethylenetriaminepentaacetic acid, polyphosphoric acid, organic phosphonic acid, aminophosphonic acid and phosphonocarboxylic acid and alkali metal, ammonium and amine salt thereof.

12. A processing solution having bleaching ability for light-sensitive silver halide photographic material, which comprises; an oxidizing agent comprising a diethylenetriaminepentaacetic acid iron (III) complex salt; and at least one metal ion selected from the group consisting of nickel, cobalt, zinc, cerium, ruthenium, yttrium, samarium, magnesium, calcium, bismuth, strontium, manganese, aluminum, tin, barium, indium, thallium and zirconium; and an aminocarboxylic acid chelating agent selected from the group consisting of dihydroxyethylglycine, iminodiacetic acid, methyliminodiacetic acid, ethyliminodiacetic acid, butyliminodiacetic acid, hydroxyethyliminodiacetic acid, nitrilotriacetic acid, nitrilotriacetic propionic acid, nitrilotripropionic acid, ethylenediaminediacetic acid, ethylenediaminedipropionic acid, ethylenediamine di-ortho-hydroxyphenyl acetic acid, hydroxyethylethylenediamine triacetic acid, ethylenediaminetetraacetic acid, diaminopropanetetraacetic acid, diaminopropanoltetraacetic acid, trans-cyclohexanediaminetetraacetic acid, glycoletherdiaminetetraacetic acid and triethylenetetraminehexaacetic acid and alkali metal, ammonium and amine salt thereof.

13. The processing solution according to claim 12, wherein said chelating agent is nitrilotriacetic acid, hydroxyethylethylenediamine triacetic acid, ethylenediaminetetraacetic acid, trans-cyclohexanediaminetetraacetic acid, diaminopropanetetraacetic acid, hydroxyethyliminodiacetic acid and diethylenetriaminepentaacetic acid or said salt thereof.

* * * * *

United States Patent [19]

Ohbayashi et al.

[11] Patent Number: 4,563,406

[45] Date of Patent: Jan. 7, 1986

[54] LIGHT-SENSITIVE SILVER HALIDE PHOTOGRAPHIC MATERIAL WITH WHITE LAYER AND COLORANT CONTAINING LAYER

[75] Inventors: Keiji Ohbayashi; Kaoru Onodera, both of Odawara, Japan

[73] Assignee: Konishiroku Photo Industry Co., Ltd., Tokyo, Japan

[21] Appl. No.: 630,333

[22] Filed: Jul. 12, 1984

Related U.S. Application Data

[63] Continuation of Ser. No. 424,273, Sep. 27, 1982, abandoned.

[30] Foreign Application Priority Data

Oct. 7, 1981 [JP] Japan ..... 56-160747

[51] Int. Cl.[4] ..... G03C 1/84

[52] U.S. Cl. ..... 430/513; 430/510; 430/517; 430/593

[58] Field of Search ..... 430/513, 517, 518, 537, 430/538, 593

[56] References Cited

U.S. PATENT DOCUMENTS

| | | | |
|---|---|---|---|
| 2,921,914 | 1/1969 | Pechmann | 430/513 |
| 3,449,122 | 6/1969 | Kretchman et al. | 430/517 |
| 3,996,050 | 12/1976 | Land | 430/517 |
| 4,078,933 | 3/1978 | Sugiyama et al. | 430/518 |
| 4,237,206 | 12/1980 | Fujita | 430/538 |
| 4,296,198 | 10/1981 | Trautweiler | 430/538 |
| 4,355,099 | 10/1982 | Trautweiler | 430/537 |

*Primary Examiner*—Jack P. Brammer

*Attorney, Agent, or Firm*—Frishauf, Holtz, Goodman & Woodward

[57] ABSTRACT

There is disclosed a light-sensitive silver halide photographic material having a white pigment containing layer and at least one silver halide emulsion layer provided successively on a support, being characterized in that there is provided a colorant containing layer capable of being made substantially colorless by a photographic treatment between said support and said white pigment containing layer. The present invention provides a light-sensitive silver halide photographic material having a reflective support improved to a great extent in sharpness substantially without bringing about lowering in sensitivity.

10 Claims, No Drawings